US005310185A

United States Patent [19]

Viollaz et al.

[11] Patent Number: 5,310,185

[45] Date of Patent: May 10, 1994

[54] GOLF CLUB HEAD AND PROCESSES FOR ITS MANUFACTURE

[75] Inventors: Francois Viollaz, Evian; Benoit Vincent, Annecy le Vieux, both of France

[73] Assignee: Taylor Made Golf Company, Carlsbad, Calif.

[21] Appl. No.: 24,400

[22] Filed: Mar. 1, 1993

[30] Foreign Application Priority Data

Feb. 27, 1992 [FR] France ..... 92 02554

[51] Int. Cl.[5] ..... A63B 53/04

[52] U.S. Cl. ..... 273/167 H; 273/167 J; 273/78; 273/DIG. 23; 273/173; 29/428

[58] Field of Search ..... 273/77 R, 162 R, 164.1, 273/193 R, 194 R, 79, 167 R-177 A, DIG. 23; 29/428, 469, 469.5, 527.5; 156/245; 264/46.7, 299

[56] References Cited

U.S. PATENT DOCUMENTS

| | | | |
|---|---|---|---|
| 1,253,700 | 1/1918 | McLaughlin | 273/167 H |
| 2,056,335 | 10/1936 | Wettlaufer | 273/171 X |
| 3,190,651 | 6/1965 | Thomas | 273/173 X |
| 4,214,754 | 7/1980 | Zebelean | 273/171 X |
| 4,438,931 | 3/1984 | Motomiya | 273/80.2 X |
| 4,618,149 | 10/1986 | Maxel | 273/167 X |
| 4,681,321 | 7/1987 | Chen | 273/167 H |
| 4,928,965 | 5/1990 | Yamaguchi | 273/78 |
| 4,940,236 | 7/1990 | Allen | 273/194 X |
| 4,984,800 | 1/1991 | Hamada | 273/173 |
| 5,000,454 | 3/1991 | Soda | 273/167 H |
| 5,106,094 | 4/1992 | Desbiolles | 273/167 H |
| 5,141,231 | 8/1992 | Cox | 273/173 |
| 5,221,087 | 6/1993 | Fenton | 273/173 |

FOREIGN PATENT DOCUMENTS

| | | | |
|---|---|---|---|
| 211781 | 12/1957 | Australia | 273/173 |
| 4288173 | 4/1992 | Japan | 273/167 J |
| 2124911 | 2/1984 | United Kingdom | 273/173 |
| 2132902 | 7/1984 | United Kingdom . | |
| 2173407 | 10/1986 | United Kingdom . | |

*Primary Examiner*—Vincent Millin
*Assistant Examiner*—Sebastiano Passaniti
*Attorney, Agent, or Firm*—Pollock, Vande Sande & Priddy

[57] ABSTRACT

Golf club head comprising a shell extended laterally by a neck, said shell being constituted by a series of metal plates forming an interior cavity, whose front plate incorporates a support surface to which a hitting plate made of a plastic or composite material is attached. The support face of the front plate is a convex surface extending forward, and the hitting plate associated with it is such that its rear plate, which is supported on the support face, has a matching shape, while the hitting surface is a convex surface extending forward.

17 Claims, 8 Drawing Sheets

FIG. 12
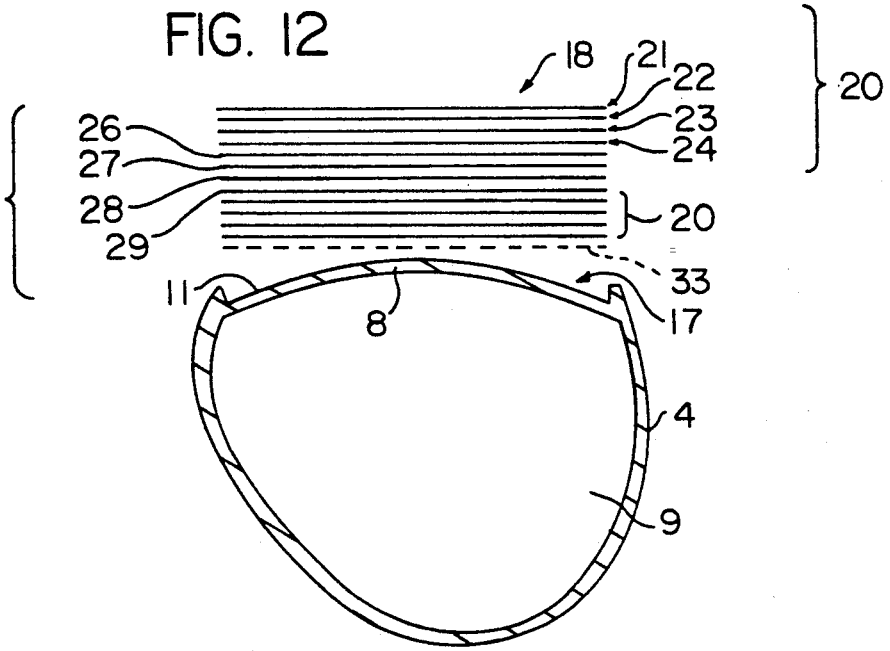
FIG. 13
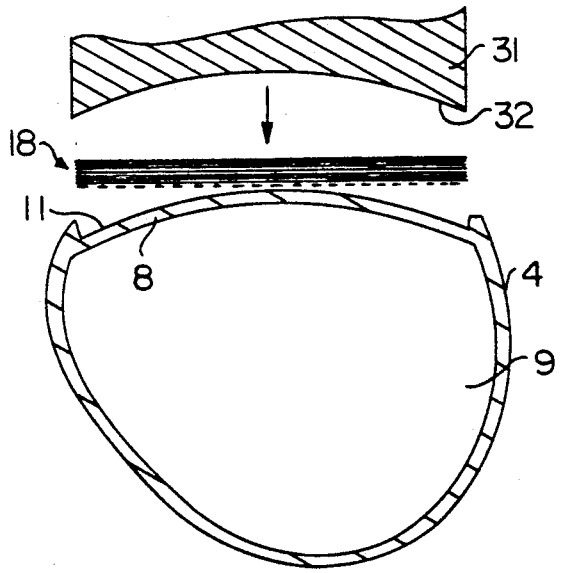
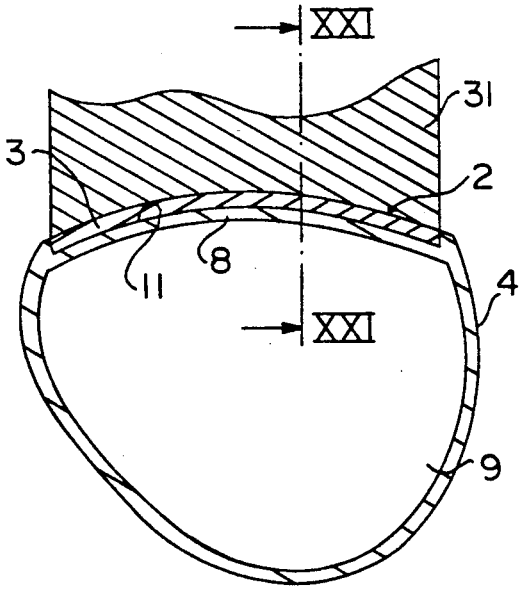
FIG. 14

FIG. 15
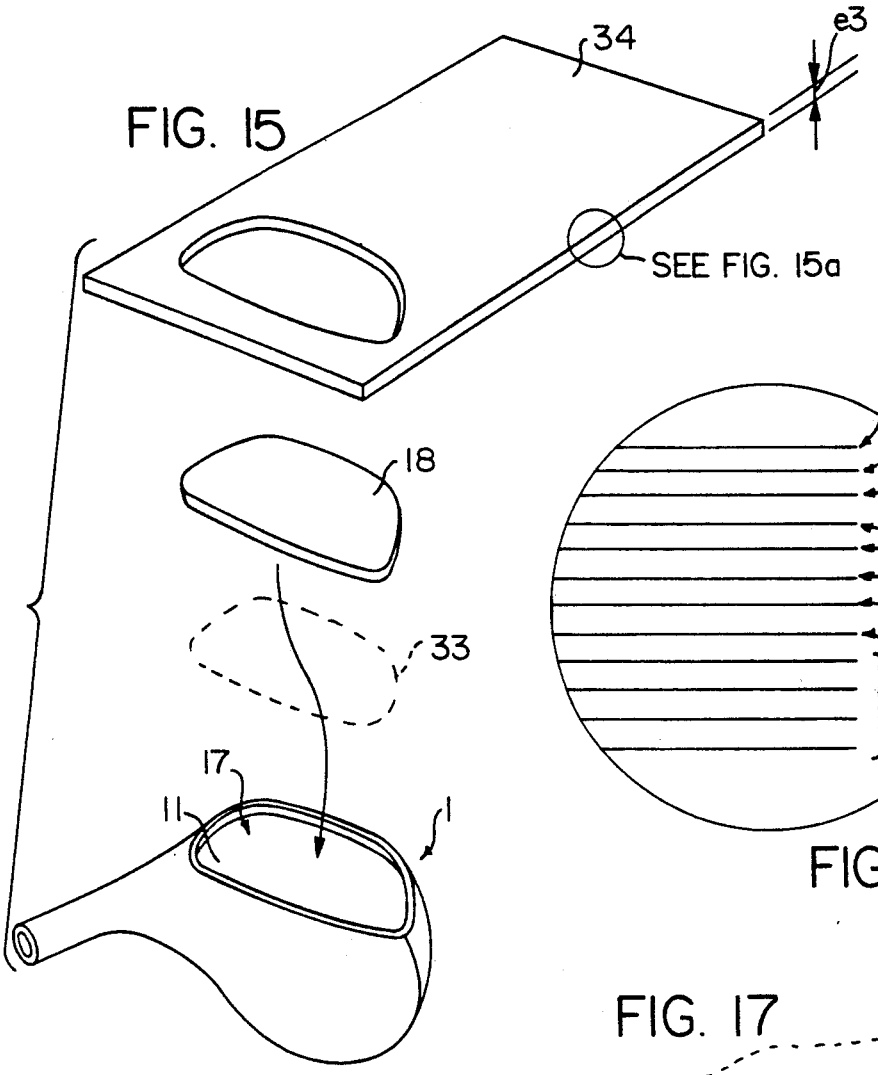
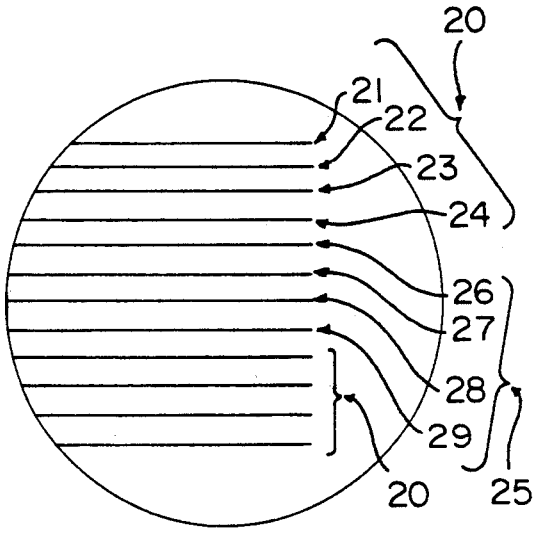
FIG. 15a
FIG. 16
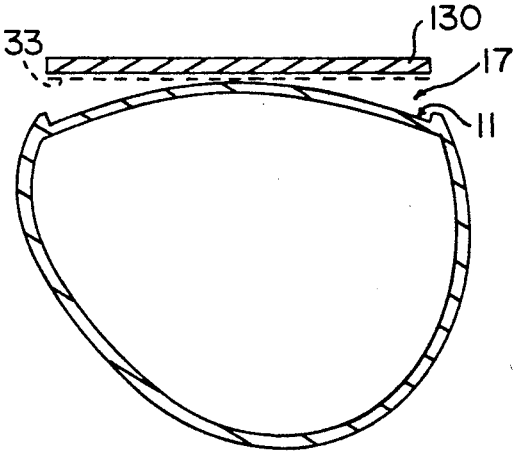
FIG. 17
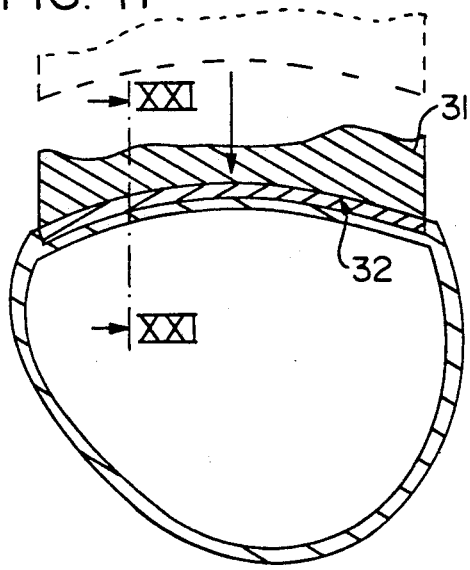

FIG. 18
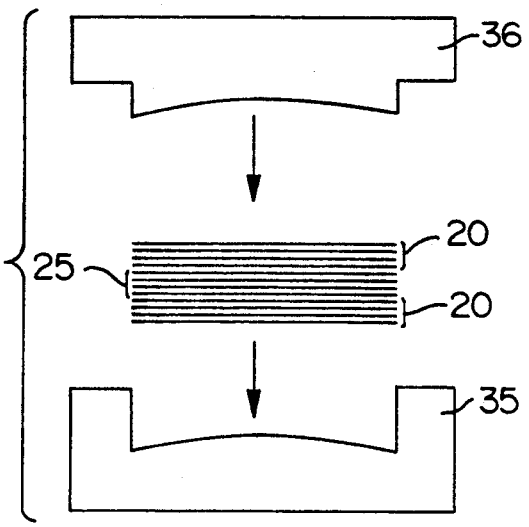
FIG. 19
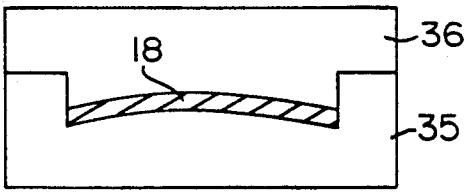
FIG. 20
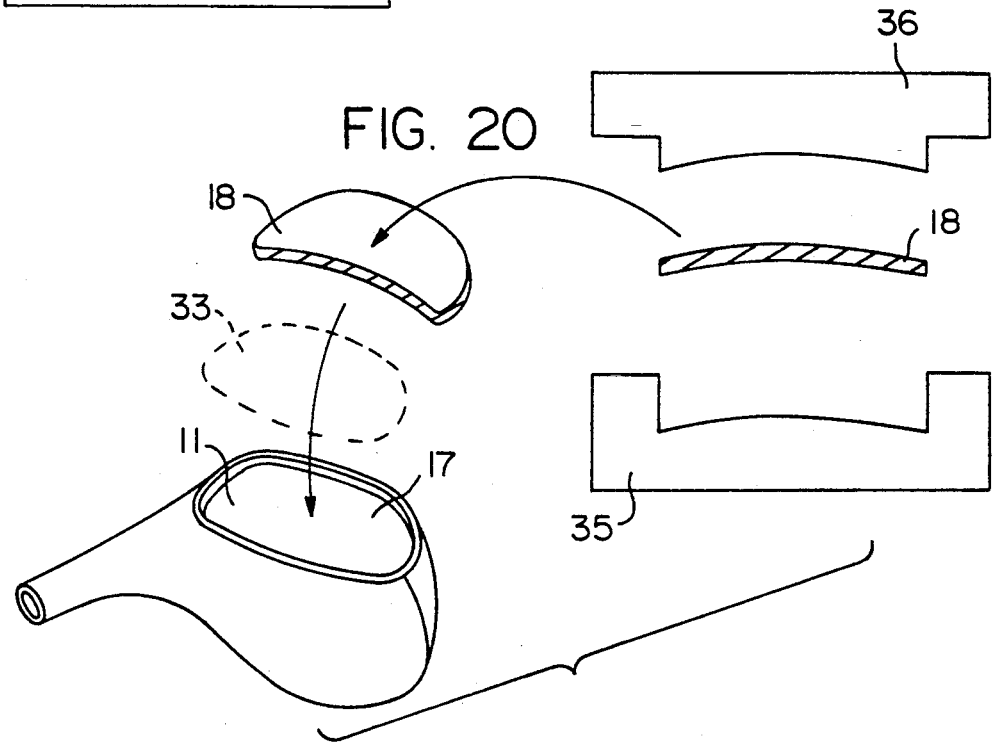
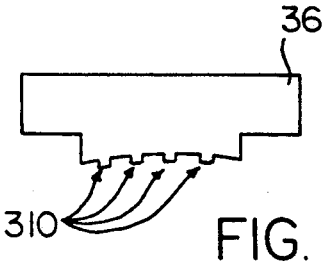
FIG. 21

GOLF CLUB HEAD AND PROCESSES FOR ITS MANUFACTURE

FIELD OF THE INVENTION

The present invention relates to an improvement for golf club heads, and more especially, heads on which the hitting surface is mounted. When golfing, the golfer strikes the ball to move it, by propelling it using a golf club incorporating a shaft comprising a head at its lower end, while its upper end is fitted with a handle, often called a grip.

BACKGROUND OF THE INVENTION

At present, the clubs used by golfers at the tee, or starting area, to drive the ball over long distances are called woods. Woods were originally constructed, in their entirety, of wood materials, such as persimmon or other similar varieties. These clubs are still prized by many golfers, but their performance tolerances are narrow, because of the low density of the material used and its homogeneous distribution behind the impact surface of the club head.

To remedy this disadvantage, the "wood-metal" club was created, a club which reproduces the shape of the wood, but whose head is made entirely of steel. Because of the high density of the material used and the necessary weight constraints, wood-metal clubs generally incorporate a hollow steel head, normally manufactured using the lost wax casting process. In this type of construction, the weight, which is mainly distributed on the periphery of the impact surface, imparts to the club a tolerance which is clearly greater than that of conventional woods. This tolerance applies both to the angle at which the ball leaves the club, an angle which determines the vertical trajectory of the ball, and to the deviation of the ball, i.e., to its lateral trajectory.

A first disadvantage of wood-metal clubs lies in the unpleasant sensations experienced by the golfer at the time of impact and caused by the contact of the metal face with the ball.

Another problem arises from the fact that the stiffness of the steel impact surface, whose thickness must be sufficient to absorb the shock of the blow, is not optimal. It can be demonstrated that reduced stiffness of the surface increases the speed of restitution, thus increasing the distance of flight. It can be shown that the stiffness of the surface depends on the thickness of the impact surface and on the modulus of elasticity of the material. For a given modulus of elasticity, reduced stiffness is, therefore, directly linked to a reduction of the thickness of this surface. It is today apparent that the optimal degree of stiffness of the impact surface of a wood-metal club corresponds to an excessive thinness, i.e., less than 3 millimeters, thus leading to irreversible deformation.

According to a well-known arrangement, the hitting surface of wood-type club heads is not planar, as is the casing for irons, but is rounded in both vertical and horizontal cross-sections. The advantage of these curvatures is that they correct the trajectory of the ball, more particularly when the point of impact of the blow is not located exactly in the center of the surface. Because of these curvatures and of present-day design of conventional clubs, their performance when used to strike the ball is uneven, a fact which golfers can only complain about.

SUMMARY OF THE INVENTION

The object of the present invention is thus to propose a golf club head, in particular a wood, incorporating a new construction which communicates pleasing sensations to the golfer at the time of impact and which ensures good ball trajectory. The invention is also intended to propose a head whose tolerance is identical to that of a club head of the same type as currently constructed, in particular of wood-metal clubs, but whose stiffness may be optimally selected, thereby making it possible to increase the contact time of the ball on the impact surface, and thus, simultaneously, the speed with which the ball leaves the club and the feeling of ball control. Moreover, the club design according to the invention makes it possible to obtain complete consistency of the force of impact, for which shapes and dimensions are completed controlled.

Accordingly, the golf club head according to the invention comprises a shell extended laterally by a neck, this shell being constituted by a series of metal plates forming an interior cavity and whose front plate comprises a support surface to which a hitting plate made of a plastic or composite material is attached, this head being characterized by the fact that the support face of the front plate is convex surface which extends forward, and by the fact that the hitting surface associated with it is such that its rear plate, supported in the support face, has a matching shape, while the hitting surface is a convex surface extending forward.

According to an additional feature, the hitting plate has a substantially constant thickness, and is such that the various points of intersection between its hitting surface and the vertical and horizontal planes are curves, and, advantageously, portions of circles.

According to another feature, the thickness of the hitting plate is substantially constant.

The golf club head according to the invention is manufactured using a process which consists in producing a shell comprising a series of plates, of which the front plate has a convex support face extending forward, and in mounting the hitting surface possessing substantially constant thickness on this front plate.

According to one preferred embodiment, the shell is manufactured using a series of metal plates, while the hitting surface is made of a composite material and is bonded in a support configuration on the support face of the front plate of this shell.

According to one embodiment of the process, the hitting surface is produced by stacking several sheets woven of resin-impregnated carbon and/or aramid fibers. For example, a succession of several woven sheets of fibers pre-impregnated with resin is placed against the support face of the hitting plate; next, this stack is compressed under heat against the front plate, in order to impart to the hitting plate its final shape, such that the convexity of the hitting surface extends forward.

According to another variant, the hitting plate is cut from a polymerized base plate formed from the stack of multiple sheets impregnated with a duroplastic resin; next, this hitting plate is place against the support face, before carrying out the compression-molding stage in order to deform the hitting plate and give it its final shape, while bonding it against this support face.

According to another variant, the hitting plate is produced separately with its final shapes and curvatures, and is then bonded against the support face of the front plate.

It will be understood that the club according to the invention thus makes possible the homogeneity of its hitting plate, and the different curvatures are faithfully reproduced, since they are defined by the metal support plate, whose manufacture is totally controlled. The homogeneity of the plate, as well as the consistency of its shapes, give the golfer confidence.

BRIEF DESCRIPTION OF THE DRAWINGS

Other features and advantages of the invention will emerge from the following description, provided with reference to the attached drawings and given by virtue of example.

FIG. 1 is a front view of the club head according to the invention.

FIG. 2 is a side view in the direction of arrow F in FIG. 1.

FIG. 3 is a top plan view.

FIG. 4 is a vertical cross-section along line IV—IV in FIG. 1.

FIG. 5 is a horizontal cross-section along line V—V in FIG. 2.

FIG. 6 is a perspective view.

FIG. 7 is a perspective view of the head without its hitting plate.

FIGS. 8 and 9 are perspective views illustrating, more especially, how the mounted hitting surface is formed.

FIGS. 10 to 20 illustrate the different manufacturing process.

FIGS. 10 illustrates a preliminary step common to all of the processes.

FIGS. 11 to 14 illustrate the different steps involved in a first procedure.

FIGS. 15 to 17 illustrate a second procedure.

FIGS. 18 to 20 illustrate another procedure according to the invention.

FIG. 21 is a transverse cross-section of the mold covers, showing an improvement.

DESCRIPTION OF THE PREFERRED EMBODIMENT

Figure 1:
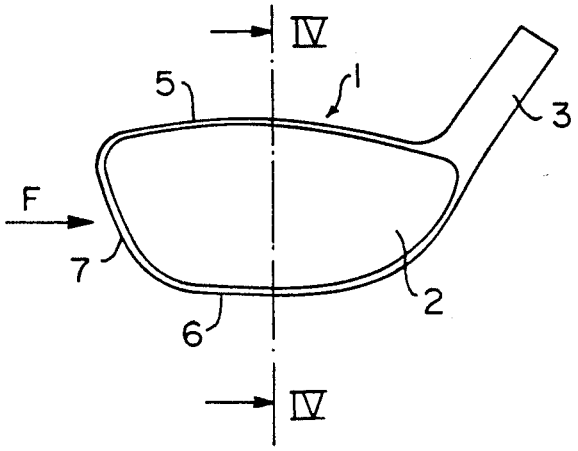
FIGS. 1 to 9 illustrate an embodiment of a golf club head according to the invention.
Figure 2:
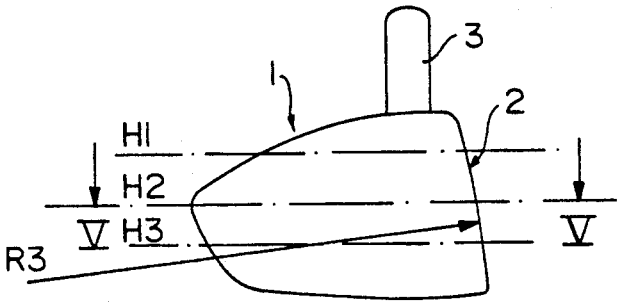
Figure 3:
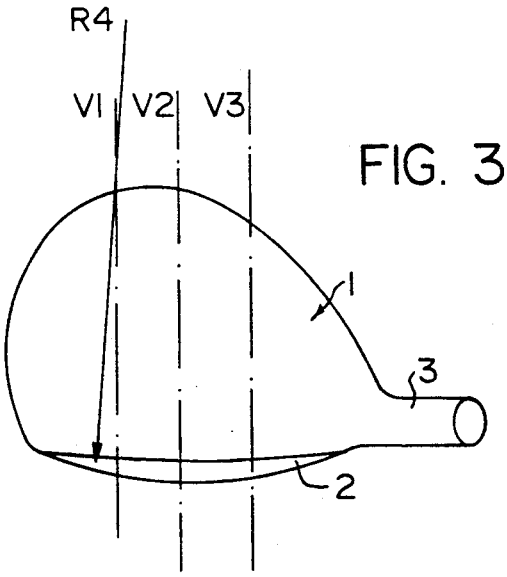
Figure 4:
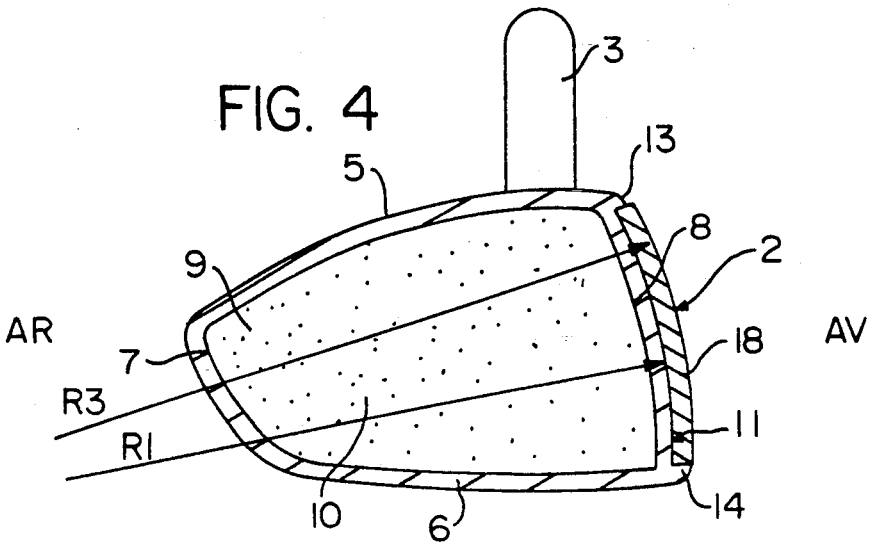
Figure 5:
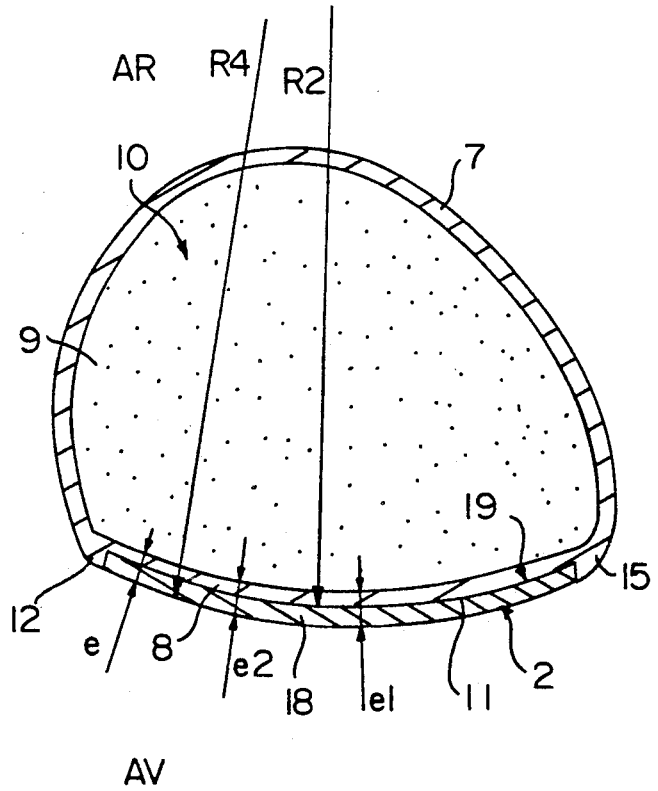
Figure 6:
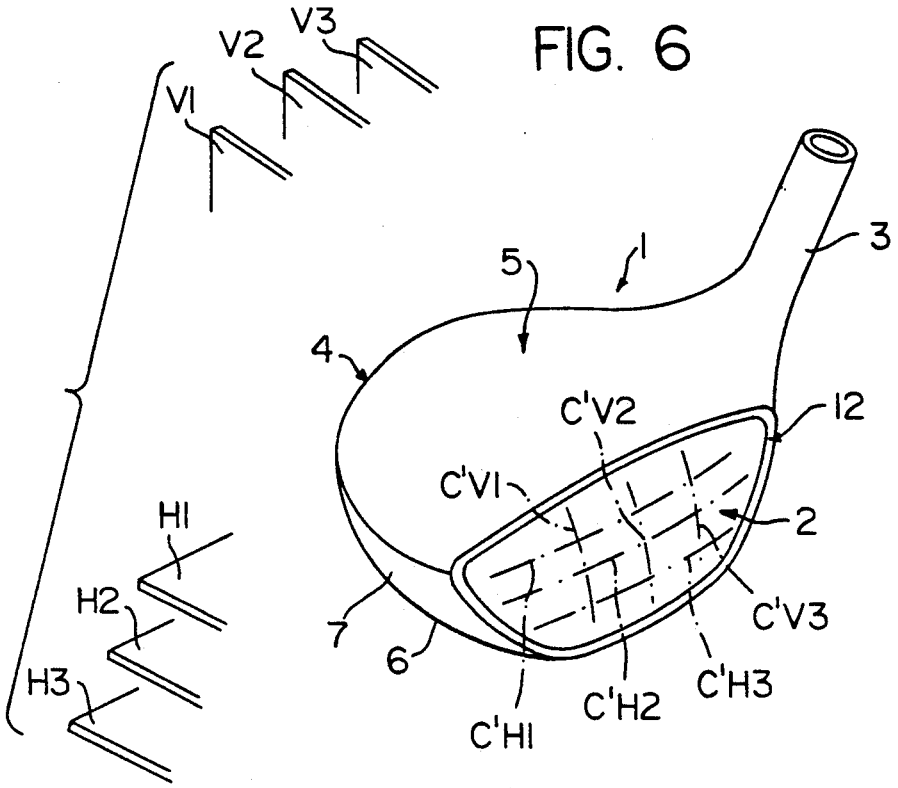
Figure 7:
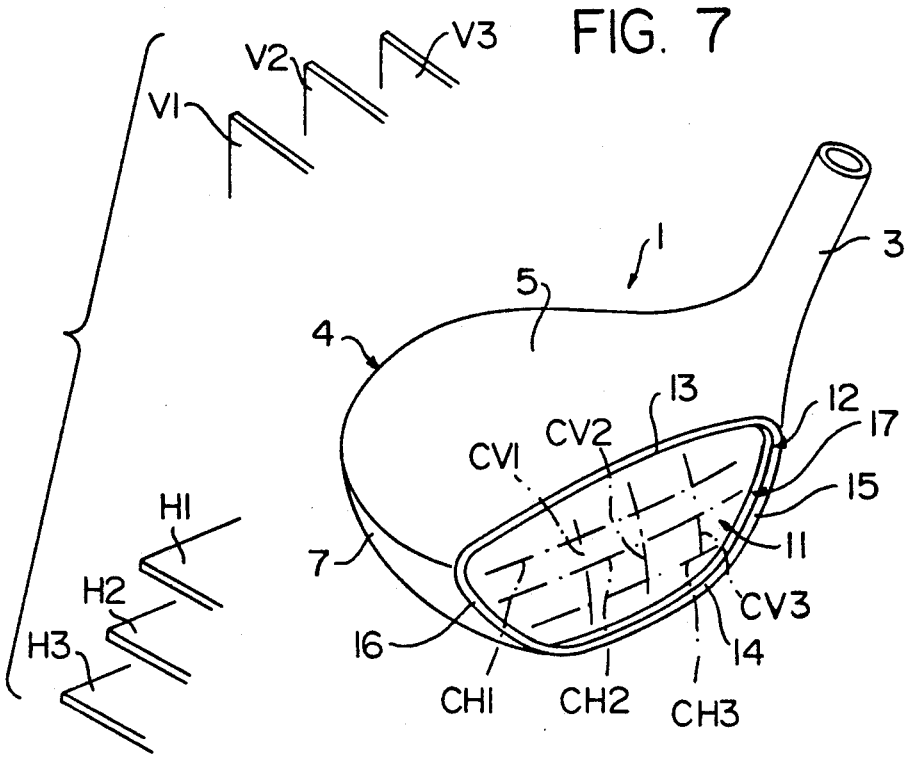

The club head according to the invention is a wood and comprises, as illustrated in FIGS. 1 to 9, a shell 1 comprising a hitting surface 2 and extended laterally and upward by a neck 3 in which the club shaft is designed to be inserted. The shell 1 itself is formed by a metal casing 4 constituted by a series of plates, i.e., an upper plate 5, a lower plate 6, a peripheral plate 7, and a front plate 8. These different plates form, a sealed hollow body creating an interior cavity 9 advantageously filled with foam 10, such as polyurethane foam.

According, to one of the inventive features, the front plate 8 has a convex front support surface 11 which extends toward the front (AV), and thus is curved in all directions. Accordingly, the different points of intersection between, the support face 11 belonging to the front plate 8 and a first set of vertical planes V1, V2, V3, etc. are a first set of curves CV1, CV2, CV3, etc. having radius R1. Similarly, the different points of intersection between this support face 11 and a first set of horizontal planes H1, H2, H3 are a second set of curves curves CH1, CH2, CH3, etc. having radius R2, R2 being advantageously equal to R1. It should also be observed that the upper plate 5, the lower plate 6, and the peripheral plate 7 are also curved, in conformity with conventional practice. The front plate advantageously comprises a small peripheral edge 12 which projects forward and is formed by an upper edge 13, a lower edge 14, an inner edge 15, and an outer edge 16, which constitute the support face 11, and a front recess 17 into which, according to the invention, a mounted hitting plate 18 is designed to be fitted The hitting plate 18 is, according to the invention, an independent component made of a composite material, which has a substantially constant thickness el and is assembled to the support face 11 of the front plate 8 by adhesive bonding, a screw arrangement, or any other means, as will be explained below. Thus, in its assembled position illustrated in FIGS. 4, 5, and 6, the hitting surface 2 of the hitting plate 18 is curved in all directions, so as to be rounded and convex toward the front AV. Accordingly, the different points of intersection between the hitting face 2 of the hitting plate 18 and a first set of vertical planes V1, V2, V3, etc., are a third set of curves C'V1, C'V2, C'V3, etc., having a radius R3. Similarly, the different points of intersection between this hitting surface 2 and a first set of horizontal planes H1, H2, H3, etc., are a fourth set of curves C'H1, C'H2, C'H3, etc., having a radius R4, R3 being advantageously equal to R4. Of course, the rear face 19 of the hitting plate 18 has a curvature identical to the support face 11 against which it is adhesively bonded.

As regards composite materials, sheets woven of carbon and/or aramid fibers impregnated with a thermoplastic or duroplastic resin material can be used. The preferred fibers include long carbon fibers having a high degree of mechanical strength, a modulus of elasticity which can vary from 230 to 590 GPa, and rupture strength between 2,450 and 7,000 MPa. These values are obviously greater than those of conventional steels. The matrices or resins may be of the polyphenylene sulfide (PPS), imide polyether (PEI), polyether-ether-ketone (PEEK), or epoxy type.

The hitting plate 18 is preferably constituted by a stack of multiple sheets woven from fibers, e.g., two-directional fibers. The specific orientation of the fibers used to make each woven sheet is illustrated as an example in FIG. 9. In this example, the plate comprises first sheets 20, 21, 22, 23, 24 whose fibers are oriented, first, in the direction of the horizontal axis (X—X') and second, in the direction of the vertical axis (Y—Y'). The plate also comprises second sheets 25, 26, 27, 28, 29 whose orientation is offset by +45° and −45° in relation to the horizontal axis X—X'. The plate preferably incorporates a successive stack of from 10 to 25 fiber sheets 20, 25.

Figure 8:
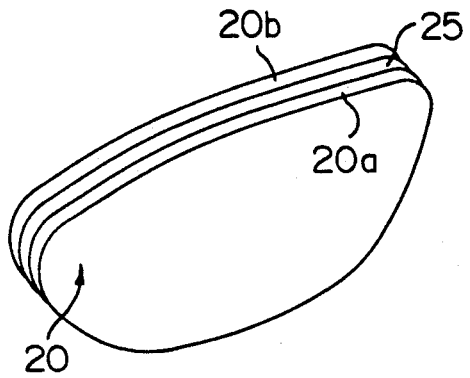
Figure 9:
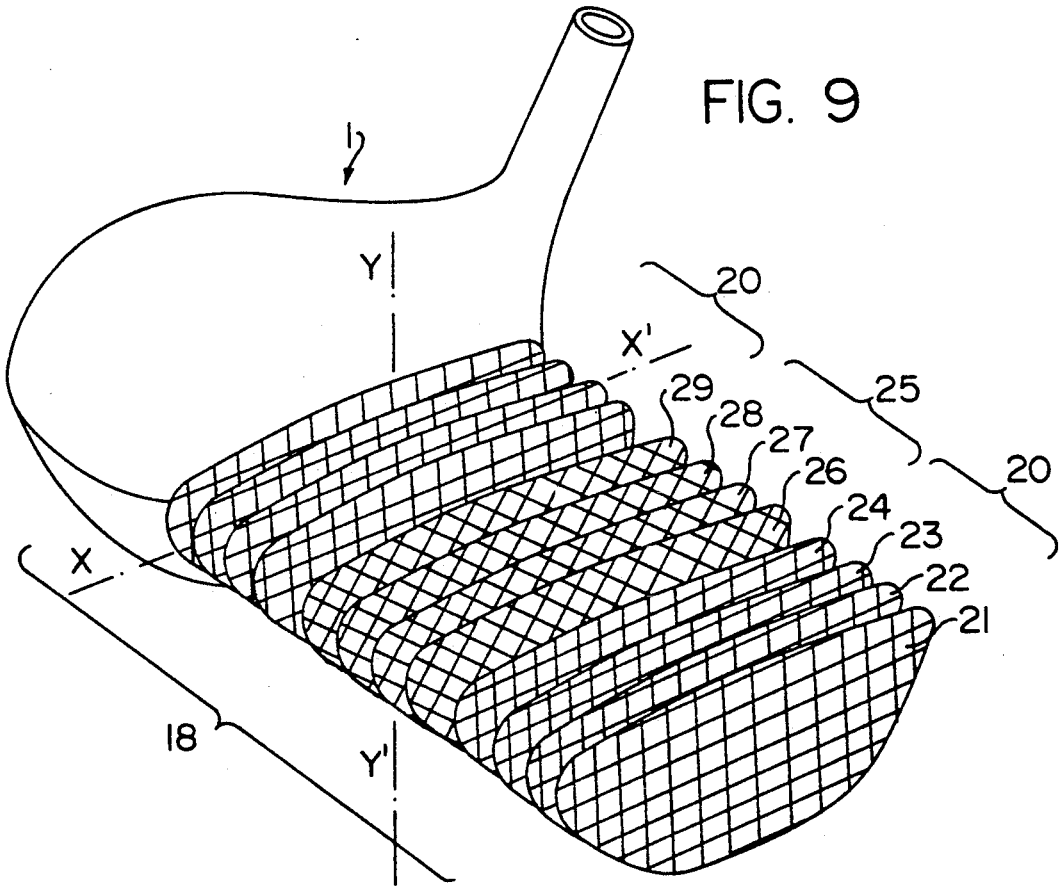

In order to optimize the strength of the plate 18, an especially advantageous sequence of first and second sheets 20 and 25, is shown in FIG. 8. Thus, the plate comprises a sequence consisting of a first outer layer **20*a* of initial sheets 20, whose fibers are oriented along the axes X—X' and Y—Y'; of a second, intermediate layer of second sheets 25, whose fibers are oriented an angle of +45° and −45° to the axis X—X'; and of a third, inner layer 20*b* of initial sheets 20**, whose fibers are oriented along the axis X—X' and the axis Y—Y'. The second, intermediate layer comprises between approximately 3 and 9 sheets.

The first, outer layer **20*a* is designed to resist compression stresses caused by the shock of the ball, and the third, internal layer 20*b*** is designed to resist tractive stress. These stresses run mainly in the direction of the axes X—X' and Y—Y'. The second, intermediate layer 25 is designed to resist shear stresses which are generated in the neutral fiber and which run principally at an angle of +45° and −45° to the axis X—X'.

An example of the construction of a resistant plate 18 made of a composite material and of its mechanical properties can be provided.

The plate is made of a stack of sheets woven, in balanced fashion, of carbon fibers and of epoxy resin. The fiber/resin volume ratio is 1. The thickness of a sheet is 0.2 mm. The fibers have a modulus of elasticity of 230 GPa and a rupture strength of 4,410 MPa (T300J fiber made by TORAY).

The stack is constituted by a first, outer layer (20*a*) made of six sheets woven from fibers extending in the direction of the axes X—X' and Y—Y' (orientation termed "0°, 90°"); of a second, intermediate layer 25 of five sheets woven from fibers extending at +45°, −45° to the axis X—X'; and of a third, inner layer 20*b* made of six sheets woven from fibers extending at 0°, 90°.

It may also be specified that a construction comprising a second, intermediate layer of three or fewer sheets only in the area of the neutral fiber is not sufficiently resistant to the shock of the ball and leads to breaking of the plate 18. This rupture phenomenon is also observed in a construction incorporating a second, intermediate layer of nine or more sheets of fibers extending at +45°,−45°, which partially replace the sheets woven of fibers at 0°, 90°.

The shell 1, and, specifically, its front plate 8, contribute to the mechanical strength and to the stiffness of the hitting plate 18, and impart to the hitting surface 2 its final curves. In addition, however, the front plate 8 acts as a bonding support for the hitting plate 18. The thickness "e2" of the front plate 8 may be between approximately 1 and 3.5 mm. The thickness "e1" of the composite hitting plate 18 may be between approximately 1 and 5 mm. Finally, to prevent oversizing leading to increased weight of the hitting plate, the total thickness "e" equal to the sum of "e1" and "e2" must not exceed approximately 7 mm, in the event that "e1" falls between 3 and 5 mm, and "e" must not exceed 5.5 mm, in the event that "e1" is between 1 and 2 mm only.

The process implemented to manufacture of the head according to two embodiments will be described below.

Figure 10:
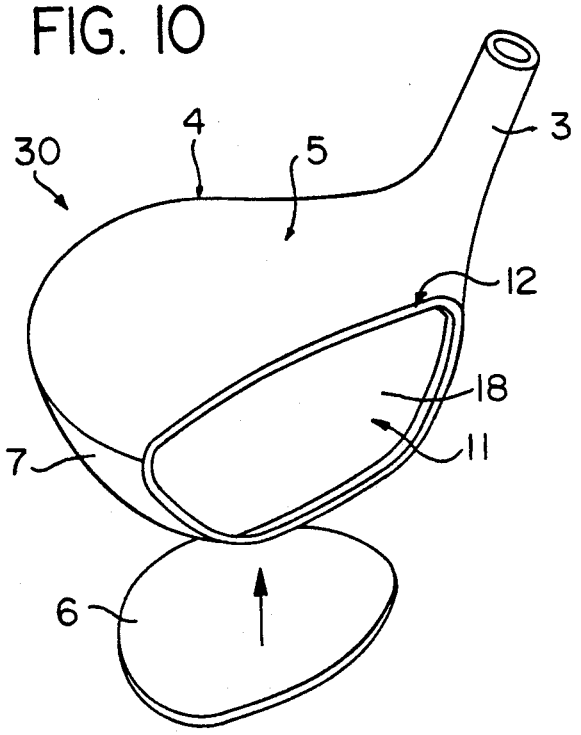

In a preliminary step (FIG. 10) common to these different processes, the casing 4 of the head and its neck 3 are made of steel. During this step, an upper sub-assembly 30 and the lower plate 6 are molded separately. This upper sub-assembly 30 comprises the upper plate 5, the front plate 8, the peripheral plate 7, and the neck 3. The lower plate 6 is then welded to the upper sub-assembly so as to form the actual shell of the head (FIG. 10).

Figure 11:
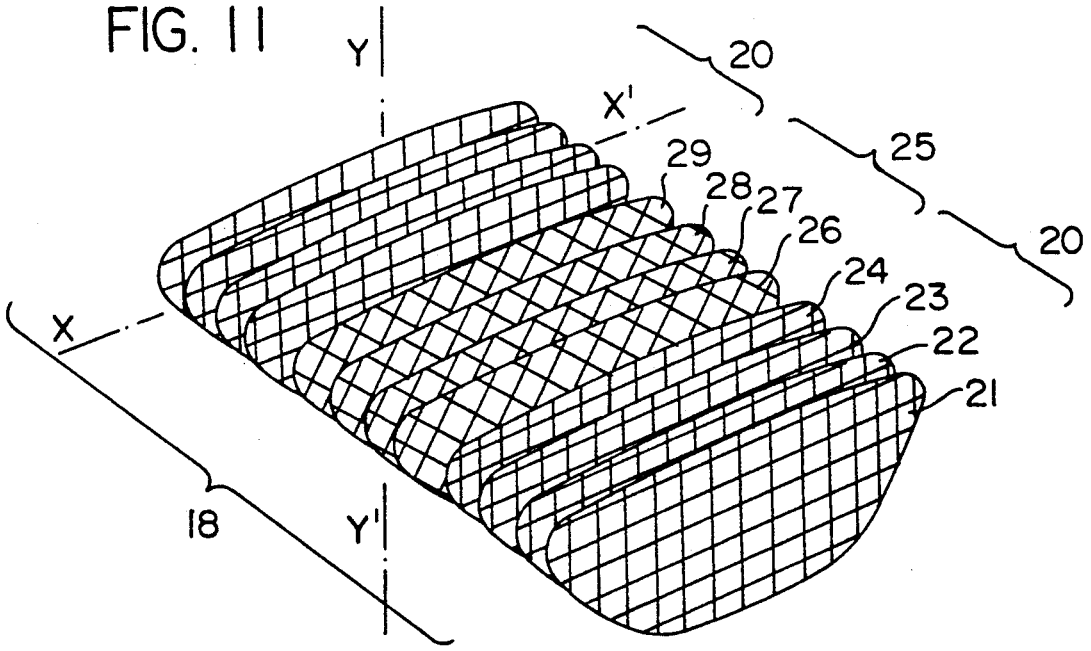

In a first manufacturing process illustrated in FIGS. 11 to 14, the hitting plate 18 is made and joined to the front plate 8, by molding it under heat and compression directly to the support face 11 of the casing 4. Preliminarily to the actual molding operation, the different sheets 20, 21, 22, 23, 24–25, 26, 27, 28, 29, such as those previously described and impregnated with non-polymerized resin are prepared (FIG. 11). Next, these various sheets are stacked (FIG. 12) on the support face 11 under the conditions previously described; next, using a mold 31, the actual molding-compression operation is effected (FIGS. 13 and 14). Molding is carried out conventionally under heat and compression, thereby ensuring, through polymerization of the resin, first, fusion of the various sheets, and second, the attachment of the hitting plate 18 thus produced to the support face 11 of the front plate 8. Furthermore, the cover 31 of the mold is such that its molding surface 32 incorporates the final curvature of the hitting surface 2 of the aforementioned hitting plate 18. Of course, it also possible to provide an intermediate adhesive bonding film 33, such as that shown in dotted lines in FIG. 12, and which could, for example, be made of a layer of a polymer- or grafted copolymer heat-fusible material. Once polymerization is completed, the head, with its hitting plate, is removed from the mold.

In a second possible manufacturing process illustrated in FIGS. 15 to 17, the hitting plate 18 is cut (FIG. 15) from a flat base plate 34 having thickness "e3", which has been previously manufactured and polymerized. This base plate is, for example, formed from a stack of different resin-impregnated sheets, as previously described. In a next step (FIG. 16), the plate element 180 designed to form the hitting plate 18 is positioned against the support face 11 of the head, in a front recess 17 provided for that purpose; next, the actual compression-molding operation is effected, as shown in FIG. 17. Molding is carried out, for example, under heat and compression at a temperature greater than the vitreous transition temperature, thus allowing the resin to be softened and the hitting plate 18 to be shaped. Of course, an intermediate bonding film 33 allowing adhesion of the hitting plate is provided. Moreover, the cover 31 of the mold is such that its molding surface 32 has the final curvature of the hitting surface 2 of the hitting plate. Once molding is completed, the piece is removed from the mold.

In another process, illustrated in FIGS. 18 to 20, the hitting plate 18 is made separately in a mold, so as to give it its final shapes and curvatures. The hitting plate 18 thus produced is then, for example, bonded against the support face 11 of the front plate. Molding of the hitting surface 18 is achieved by stacking 30 pre-impregnated sheets in a mold 35 (FIG. 18). Molding is effected under heat and compression (FIG. 19), thus ensuring polymerization of the impregnation resin. The plate 18 thus molded to its final shape by virtue of the mold impression is then removed from the mold, in order to be bonded to the support face 11 of the casing.

It is evident that the parallel grooves that must be incorporated into the hitting surface 2 can be produced either during molding-compression of the hitting plate, or during a subsequent machining operation. These grooves are preferably produced during the molding stage, and, to that end, the top of the mold cover comprises a series of parallel projecting ribs 310, as shown in FIG. 21.

The hitting plate 18 may also be made of a plastic material and manufactured separately to its final shapes and dimensions, for example by injection of a thermoplastic material. The hitting surface thus produced is then adhesively bonded to the corresponding support face. Moreover, the plate called for in the process illustrated in FIGS. 15 to 17 may be made of a plastic material; in that case, the plate element 180 may be heat-shaped in order to give it the pre-determined curvatures.

In addition, the stack of sheets may be produced in an unbalanced fashion, so that the shaping of the final curvatures of the hitting plate occurs naturally, by deformation, during the heating of the latter.

What is claimed is:

1. A golf club head comprising a shell (1) extended laterally by a neck (3), said shell comprising a series of metal plates (4) forming an interior cavity (9) and including a front plate (8) comprising a support surface (11) to which a hitting plate (18) made of a plastic or composite material is fastened, wherein said support surface (11) belonging to said front plate (8) is a convex surface extending in a direction of intended flight of a struck ball and said hitting plate (18) associated with said support surface has a rear face (19) supported on said support surface (11) and a shape matching a shape of said support surface, and has a hitting surface (2) which is convex int he direction of intended flight of a struck ball.

2. A golf club head according to claim 1, wherein the different points of intersection between said support surface (11) belonging to said front plate (8) and a first set of vertical planes are a first set of curves, and the points of intersection with a first set of horizontal planes are a second set of curves.

3. A golf club head according to claim 2, wherein the first set of curves are portions of circles having a radius R1, and the second set of curves are portions of circles having a radius R2.

4. A golf club head according to claim 3, wherein the radii R1 and R2 are equal.

5. A golf club head according to claim 1, wherein said hitting plate (18) has a substantially uniform thickness "e1."

6. A golf club head according to claim 1, wherein said hitting plate (18) is such that different points of intersection between said hitting surface (2) and a first set of vertical planes are a third set of curves, and the points of intersection with a first set of horizontal planes are a fourth set of curves.

7. A golf club head according to claim 6, wherein the third set of curves are portions of circles having a radius R3, and the fourth set of curves are portions of circles having a radius R4.

8. A golf club head according to claim 7, wherein said radii R3 and R4 are equal.

9. A golf club head according to claim 8, wherein the thickness "e2" of said hitting plate is substantially uniform.

10. A golf club head according to claim 1, wherein said head is a wood-type head and said shell (1) comprises a series of metal plates (4), wherein said cavity (9) is filled with a foam (10).

11. A process for manufacture of a golf club head, consisting of producing a shell (1) comprising a series of metal plates (4), including a front plate (8) having a support face (11) whose convexity extends in a direction of intended flight of a struck ball, and in mounting on said front plate (8) a hitting plate (18) having a substantially uniform thickness.

12. A process for manufacture of a golf club head according to claim 11, wherein said shell (1) is produced using a series of metal walls (5, 6, 7, 8), while said hitting plate (18) is made of a plastic or composite material.

13. A process for manufacture of a golf club head according to claim 12, wherein said hitting plate (18) is adhesively bonded in a supported position to said support face (11) belonging to said front plate of said shell (1).

14. A process for manufacture of a golf club head according to claim 13, wherein said hitting plate (18) is made using a stack of multiple sheets woven of resin-impregnated carbon and/or aramid fibers.

15. A process for manufacture of a golf club head according to claim 14, wherein a stack comprising a series of multiple sheets woven of fibers pre-impregnated with resin (20, 21, 22, 23, 24, 25, 26, 27, 28, 29) is placed against said support face (11) of said hitting plate (8), and, next, said stack is compressed under heat against said front plate, in order to impart to said hitting plate (18) its final shape, such that a hitting surface (2) is convex toward the front.

16. A process for manufacture of a golf club head according to claim 14, wherein said hitting plate (18) is cut from a polymerized base plate (34) formed from said stack of multiple woven fiber sheets impregnated duroplastic resin, said hitting plate is then placed against said support face (11), and a compression-molding step is then carried out, in order to deform said hitting plate (18) and give it its final shape, while adhesively bonding it against said support face (11).

17. A process for manufacture of a golf club head according to claim 14, wherein said hitting plate (18) is manufactured separately to its final shape and curvatures, then is bonded against said support face (11) belonging to said front plate (8).

* * * * *